US006568985B1

(12) United States Patent
Binkley

(10) Patent No.: US 6,568,985 B1
(45) Date of Patent: May 27, 2003

(54) AERIAL PUMP TOY

(76) Inventor: Dennis E. Binkley, 1546 Woodbine Way, Seattle, WA (US) 98177-5339

( * ) Notice: Subject to any disclaimer, the term of this patent is extended or adjusted under 35 U.S.C. 154(b) by 0 days.

(21) Appl. No.: 10/254,983

(22) Filed: Sep. 24, 2002

(51) Int. Cl.[7] ..... A63H 27/14
(52) U.S. Cl. ..... 446/176; 446/231; 446/429
(58) Field of Search ..... 446/176, 177, 446/180, 34, 230, 231, 429

(56) References Cited

U.S. PATENT DOCUMENTS 3,077,876 A * 2/1963 Richter ..... 124/65
4,038,776 A * 8/1977 Filipeli ..... 446/52
4,223,472 A * 9/1980 Fekete et al. ..... 446/192
5,188,557 A * 2/1993 Brown ..... 446/212

* cited by examiner

*Primary Examiner*—Jacob K Ackun

(74) *Attorney, Agent, or Firm*—Jensen & Puntigam, P.S.

(57) ABSTRACT

An aerial toy includes a hollow sleeve member which is open at both ends and a base member which acts as a pump into which the sleeve fits longitudinally in a sliding arrangement, wherein movement of the base member from a first extended position to a second position along the hollow sleeve member results in air moving out the upper end of the sleeve. A launch tube portion fits onto an upper end of the hollow sleeve member. A flying member which is made from a compressible foam is mountable on the launch tube, the flying member having at least one constriction along its length, wherein the internal diameter of a body portion of the flying member is slightly decreased at the constriction, providing a tighter fit between the flying member and the launch tube without significantly increasing the force necessary to mount the flying member on the launch tube.

6 Claims, 4 Drawing Sheets

AERIAL PUMP TOY

TECHNICAL FIELD

This invention relates generally to aerial toys, and more specifically concerns such a toy which includes a flying member such as a rocket, an airplane or the like which is launched by air action involving a pump portion of the toy.

BACKGROUND OF THE INVENTION

Aerial toys which include a flying member, such as shown in FIG. 1, are well known. Such toys include a pump portion which is used to launch the flying member. The toy shown generally at 10 in FIG. 1, which is illustrative, includes a hollow sleeve element 12, a base pump member 14 into which one end of the sleeve element 10 fits, and a launch tube 16 mounted at the other end of the sleeve, upon which the flying member 18, such as a rocket, is mounted. In FIG. 1, the sleeve 12 is shown all the way into the base member 14, while the flying member 18 is shown fully onto the launch tube 16, which is connected to the top of the sleeve. In operation, the pump member is moved from an extended position, in which a substantial portion of the sleeve is exposed, to a position farther up along the sleeve, forcing air up through the launch tube which in turn forces the flying member positioned thereupon off of the launch tube and into flight.

It is desirable that the flying member fly for as long and far as great a distance as possible. However, a long flight typically requires a very tight fit between the flying member and the launch tube, which results in a substantial amount of air pressure building up within the launch tube before the flying member is launched, i.e. before the pressure overcomes the resistance between the launch tube and the flying member. The substantial air pressure accounts for the long flight. However, the disadvantage of this arrangement is that a significant amount of force is required to position the flying member on the launch tube, i.e. forcing the flying member, which has an open internal volume, onto the launch tube. Young children often have significant difficulty in accomplishing this. A flying member on the other hand can configured with a sufficiently large internal diameter so that it is relatively easy to position the flying member on the launch tube; in such a case the flying member will launch at a relatively low air pressure and the flying member will not fly very far or long.

It would be desirable if the flight time and distance of the flying member could be increased without adding significantly to the cost or complexity of the existing toy and with the flying member being relatively easy to mount on the launch tube portion of the toy.

SUMMARY OF THE INVENTION

Accordingly, the present invention is an aerial toy, comprising: a hollow sleeve portion, open at both ends; a base member into which the sleeve portion fits longitudinally in a sliding arrangement, the base member being closed at a lower end thereof, such that movement of the base member from a first extended position relative to the sleeve portion to a second position a substantial distance along the sleeve portion results in air moving out the upper end of the sleeve portion; and a flying member having an opening at one end which extends into an internal opening and mountable on the launch tube by a user, the flying member having at least one constriction along its length where the interior diameter of the flying member is slightly decreased, resulting in a tighter fit between the flying member and the launch tube than along the remainder of the flying member, producing a longer flight for the flying member, while still being conveniently mountable on the launch tube.

BEST MODE FOR CARRYING OUT THE INVENTION

Figure 1:
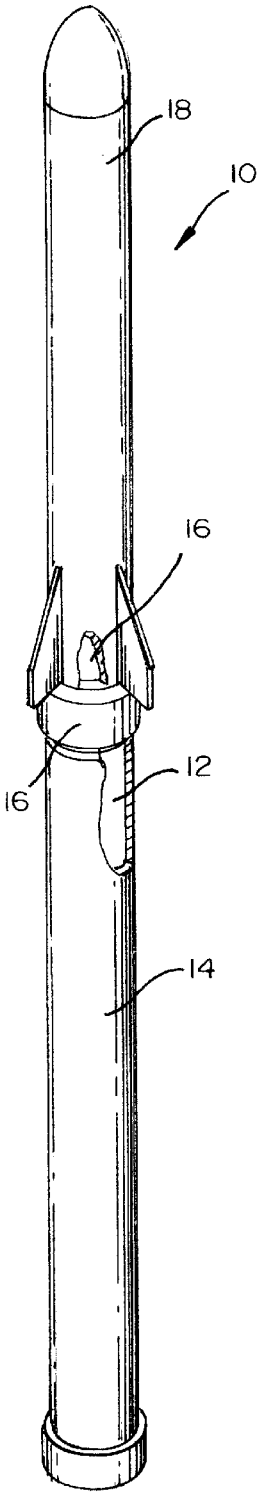
FIG. 1 PRIOR ART
FIG. 1 is an elevational, partially cutaway view of an aerial fly toy known in the prior art.
Figure 2A:
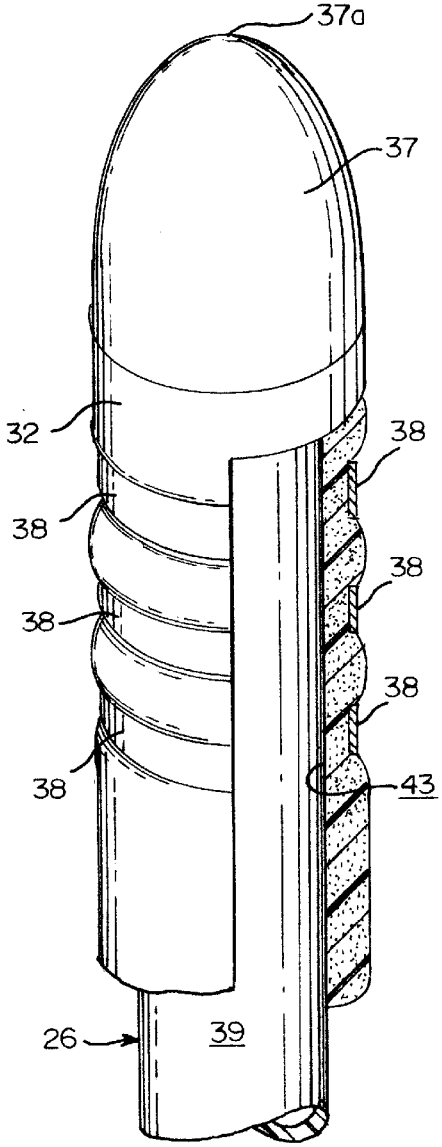
FIG. 2A is an elevational, partially cutaway view of a portion of the article of FIG. 2.
Figure 2:
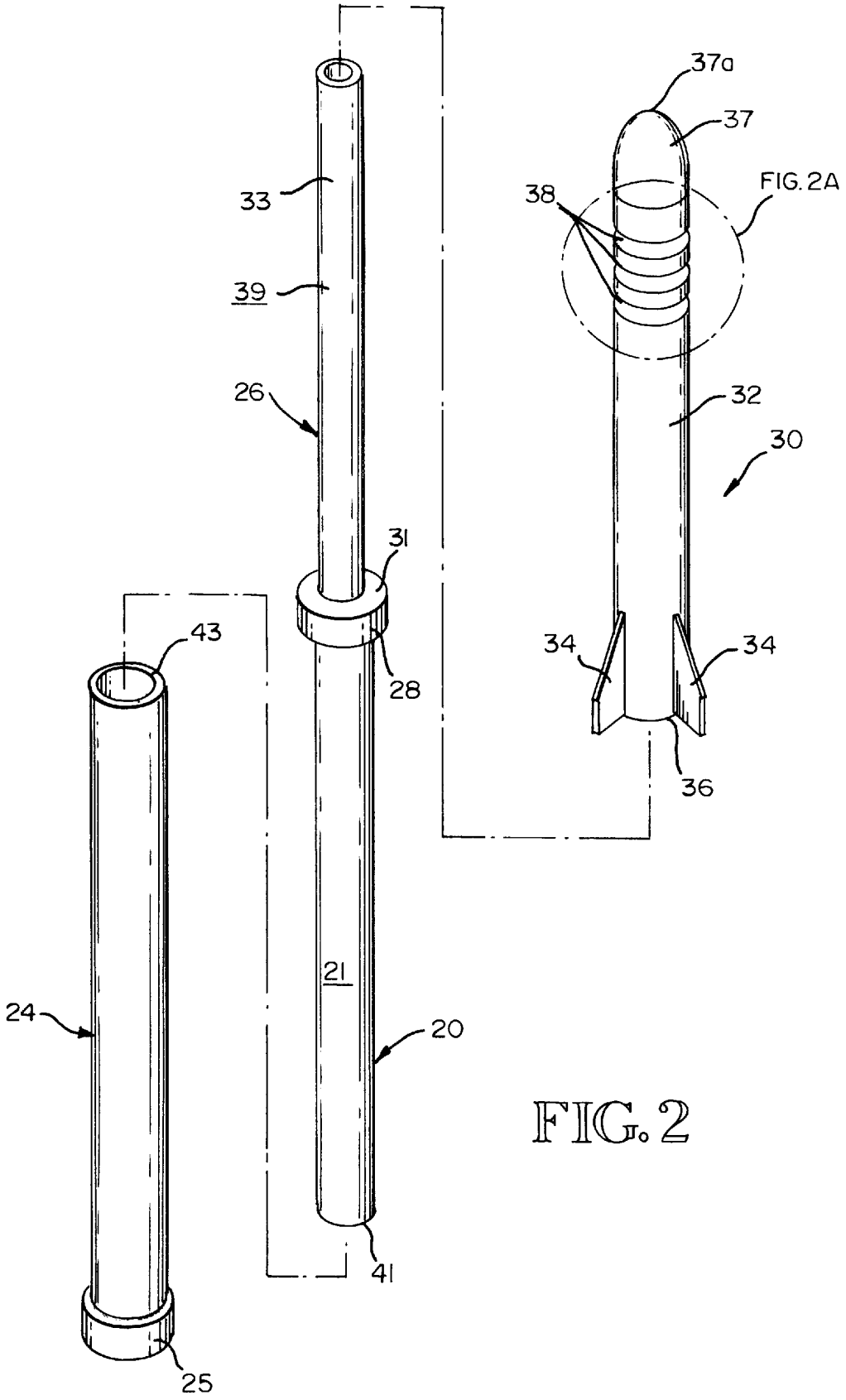
FIG. 2 is an exploded view of the aerial fly toy of FIG. 1 modified in accordance with the present invention.

Referring now in detail to the present invention, and FIG. 2 in particular, the aerial toy assembly in the embodiment shown includes an elongated cylindrical sleeve 20, which is approximately 22 inches long and approximately two inches in diameter. Sleeve 20 is approximately 1/16 inch thick, is made from plastic and is open at both ends. The dimensions and material of the sleeve 10 could, however, be changed. The external surface 21 of sleeve 20 is quite smooth. Sleeve 20 fits into a base pump element 24, which in the embodiment shown, is a hollow cylinder approximately 20½ inches long, with an internal diameter selected such that sleeve 20 fits readily longitudinally in a base pump element 24. Pump element 24 has a closed rear end by a cap 25. The pump element 24 is moveable along sleeve 20 by a relatively easy sliding motion, in a substantial air-tight relationship.

A launch tube member 26 fits on the upper end 27 of sleeve 20 and extends upwardly therefrom. Launch tube 26 is open at both ends. Alternatively, the launch tube member could be an extension of sleeve 20, i.e. a single unit. Launch tube member 26 includes a first portion 28 which has an internal diameter which is just sufficient to fit over and connect with the upper end of sleeve 20 in a fairly tight relationship. A moderate amount of force is necessary to fit the launch tube onto and to remove it from sleeve 20. The connection is airtight. The first portion 28 of launch tube 26 is approximately 1½ inches long. At the far end 30 of first portion 28 is a tapered portion (second portion) 31 which reduces the diameter of the launch tube to approximately 1¼ inches. The remainder (third portion) 33 of the launch tube has a diameter of approximately 1¼ inches and is approximately 14½ inches long. The entire launch tube is also made of a hard plastic, approximately 1/16-inch thick.

Positioned on the remainder portion 33 of launch tube 26 is an aerial flying member 30, which has a hollow interior, opening to the lower end 36 thereof. Flying member 30 can take various configurations, but FIG. 2 shows a rocket-like article with an elongated body 32 and three spaced stabilizing fins 34—34 at the lower end 36 thereof. Body 32 includes a nose portion 37 which extends to a rounded point 37*a* at the distal end of the body. In the embodiment shown, the length of the flying member from a lower end thereof to an upper end is approximately 17½ inches, although this can be varied. In the embodiment shown, body 32 is made from a soft foam material. The foam material is compressible, but is also resilient, capable of rebounding to approximately its original configuration after it has been released. In some cases, the curved nose portion 37 may be a softer foam material than the remainder of the body 32. The fins 34 are thin and made of a flexible, soft plastic.

Figure 3A:
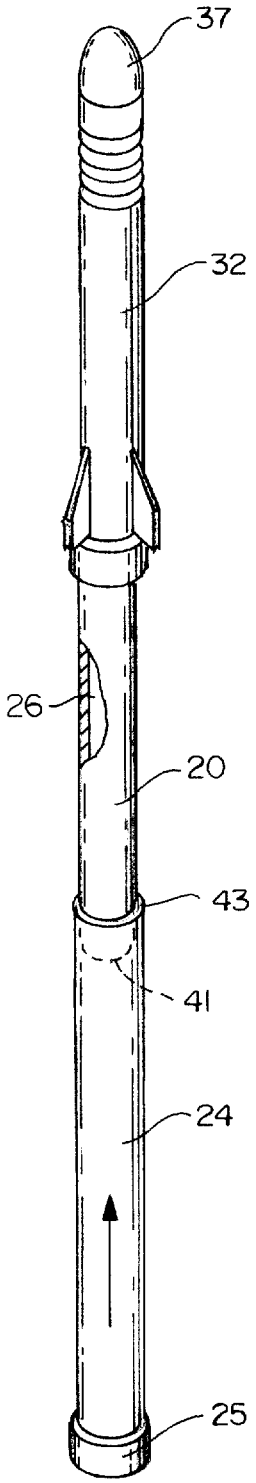
FIGS. 3A and 3B illustrate the pumping/launch action of the flying toy of the article of FIG. 2.
Figure 3B:
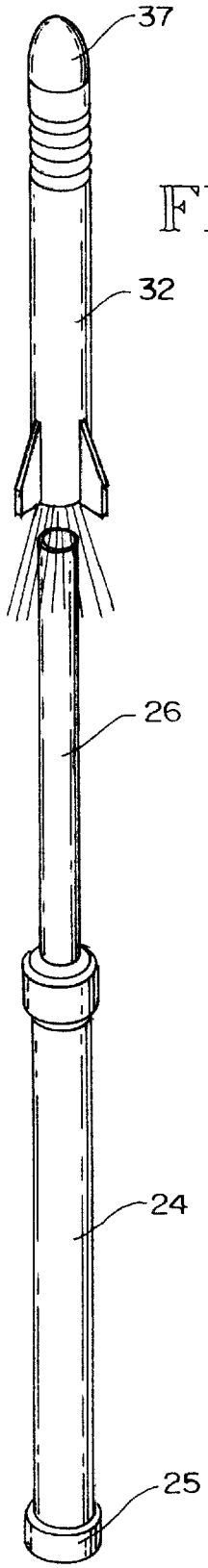

As indicated above, the tightness of the fit between the interior surface of body 32 of the flying member and the exterior surface 39 of the launch tube 26 determines the distance and also the time which the flying member travels. In operation, the user pulls the base pump element 24 to a rearward, extended position in which a rear edge 41 of the sleeve 20 is near the top forward edge 43 of the pump element, as shown in FIG. 3A. The user then moves pump element 24 quickly along sleeve 20, while holding the sleeve fast, thereby forcing air through sleeve 20 and launch tube 26, which results in the flying member 30 being driven off of the launch tube 26 and into the air when the air pressure is sufficient to overcome the resistance between the flying member and the launch tube. The resulting launching of the flying member is shown in FIG. 3B.

Again, if the fit between the interior surface 43 of the flying member and the launch tube 26 is sufficiently tight, the flying member 30 will fly a considerable distance. The fit must not be so tight, however, that the increase in air pressure within the tube is insufficient to launch the flying member. The desired tight fit, however, has the disadvantage of making it quite difficult for a young user to position the flying member onto the launch tube, due to the force required. However, if the fit is loosened too much, a reduced amount of air pressure will launch the flying member, with a resulting shorter flight distance and time.

In order to accomplish the objectives of the "tight fit" between the flying member and the launch tube, but while also maintaining relative ease of positioning the flying member onto the launch tube, three bands 38—38 are positioned circumferentially around the body 32 of the flying member, near the top end thereof in the embodiment shown. These bands, which can be elastic tape, solid plastic, metal or other arrangements, are positioned around the body with such a diameter as to compress the body 32 inwardly in those regions, producing a decrease in the interior diameter of the body in those regions, referred to herein as constrictions. The constrictions can be continuous or segmented. While three separate bands are shown, each approximately ¾ inch wide, there could be fewer or more bands, with different dimensions. For instance, a single band could be used. This could be molded plastic which can be conveniently placed on the flying member during manufacture, with the molded band being of uniform dimensions to ensure uniformity of effect/result on the flying member's flight. The bands must be sufficient, however to produce the desired tightness of fit between the flying member and the launch tube to produce a longer flight time/distance without significantly increasing the force necessary to position the flying member on the launch tube.

Such an arrangement overcomes the disadvantages of prior devices in a simple inexpensive manner, without adding to the complexity or expenses of the toy to a significant degree, if at all.

Figure 4:
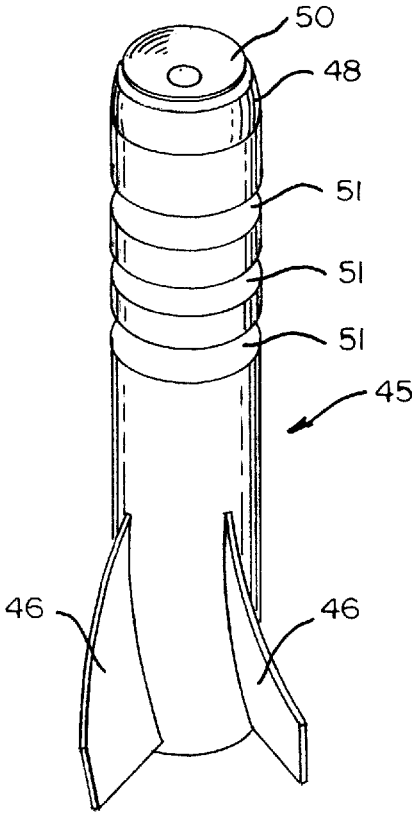
FIG. 4 is a perspective view of one alternative flying member of the article of FIG. 2.
Figure 5:
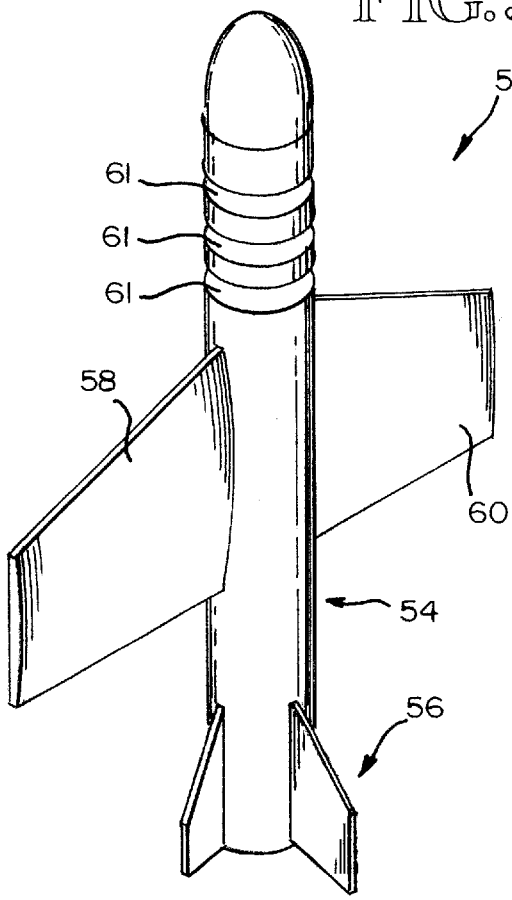
FIG. 5 shows an alternative flying member.

FIGS. 4 and 5 show different flying member configurations, illustrating that the exterior configuration of the flying member can be changed. In FIG. 4, the body 45 is shortened to approximately 11 inches; fins 46 are retained. The nose portion 48 of the body is quite short, with a suction cup 50 on the forward end thereof. Three bands 51—51 are provided with corresponding constrictions. This embodiment can be used as a catch game, with other players having a glove or implement which can capture the flying device, or the flying member can be directed toward a target. Again, different band arrangements can be used, including a single band.

FIG. 5 shows the flying member in the shape of an airplane, shown generally at 52, the airplane having a body portion 54, an airplane tail section 56 and wings 58 and 60, with bands/constrictions (including a single band) 61—61. The aerodynamic shape of the airplane embodiment will increase the range and time of flight.

The particular flying member alternatives shown in FIGS. 2–5 are illustrations of possible configurations. It should be understood that other flying member configurations could be used. However, each configuration will include the constriction(s) in the body portion, which provides the required tight fit for to produce the desired long flights, without significant force being necessary to mount the flying member in the launch tube.

Hence, an improved aerial toy has been shown and described, in which the flying member is readily mountable on a launch portion of the toy, but includes one or more constrictions along its length to provide a tight air seal between the launch tube and the flying member, allowing air pressure to build up within the toy.

What is claimed is:

1. An aerial toy, comprising:

a hollow sleeve portion, open at both ends;

a base member into which the sleeve portion fits longitudinally in a sliding arrangement, the base member being closed at a lower end thereof, such that movement of the base member from a first extended position relative to the sleeve portion to a second position a substantial distance along the sleeve portion results in air moving out the upper end of the sleeve portion;

a launch tube portion extending from or part of an upper end of the sleeve portion; and a flying member having an opening at one end into an internal opening and mountable on the launch tube by a user, the flying member having at least one constriction along its length where the interior diameter of the flying member is slightly decreased, resulting in a tighter fit between the flying member and the launch tube than along the remainder of the flying member, producing a longer flight for the flying member, while still being conveniently mountable on the launch tube.

2. A toy of claim 1, including three spaced constrictions along the length thereof, each constriction being approximately the same size.

3. A toy of claim 1, wherein the constriction is continuous around the periphery of the internal opening of the flying member.

4. A toy of claim 1, wherein the constriction is formed by a band of specified diameter which is positionable around the flying member.

5. A toy of claim 1, wherein the flying member comprises compressible foam material and the constrictions are produced by tape wrapped around the flying member at selected points along the length thereof, the tape decreasing the internal diameter of the flying member by a selected amount at that point.

6. A toy of claim 1, wherein the hollow sleeve portion and the launch tube portion are separate elements, the launch tube portion having an external diameter which is slightly less than the interior diameter of the hollow sleeve and wherein the launch tube portion is mounted to an upper end of the hollow sleeve portion.

* * * * *